US012168550B2

(12) United States Patent
Maelstaf

(10) Patent No.: US 12,168,550 B2
(45) Date of Patent: Dec. 17, 2024

(54) CLOSURE MEMBER FOR AN ASSEMBLY FOR PACKAGING AND DISPENSING A PRODUCT, AND ASSEMBLY COMPRISING SUCH A CLOSURE MEMBER

(71) Applicant: L'OREAL, Paris (FR)

(72) Inventor: Luc Maelstaf, Clichy (FR)

(73) Assignee: L'Oreal, Paris (FR)

( * ) Notice: Subject to any disclaimer, the term of this patent is extended or adjusted under 35 U.S.C. 154(b) by 31 days.

(21) Appl. No.: 18/002,623

(22) PCT Filed: Jun. 28, 2021

(86) PCT No.: PCT/EP2021/067686
§ 371 (c)(1),
(2) Date: Dec. 20, 2022

(87) PCT Pub. No.: WO2022/002847
PCT Pub. Date: Jan. 6, 2022

(65) Prior Publication Data

US 2023/0234756 A1 Jul. 27, 2023

(30) Foreign Application Priority Data

Jun. 29, 2020 (FR) ..... 2006811

(51) Int. Cl.
*B65D 43/02* (2006.01)
*B65D 47/08* (2006.01)

(52) U.S. Cl.
CPC ..... *B65D 43/021* (2013.01); *B65D 47/0838* (2013.01); *B65D 2255/20* (2013.01)

(58) Field of Classification Search
CPC ..... B65D 47/0838; B65D 47/0804; B65D 47/08; B65D 43/0272; B65D 43/022;
(Continued)

(56) References Cited

U.S. PATENT DOCUMENTS 3,380,610 A * 4/1968 Krieps ..... B65D 43/022 215/320
3,456,650 A * 7/1969 Schwartzman ..... B65D 47/42 222/495

(Continued)

FOREIGN PATENT DOCUMENTS

EP 1 086 903 A2 3/2001

OTHER PUBLICATIONS

International Search Report and Written Opinion as mailed on Oct. 18, 2021, issued in corresponding International Application No. PCT/EP2021/067686, filed Jun. 28, 2021, 10 pages.

*Primary Examiner* — Ernesto A Grano
(74) *Attorney, Agent, or Firm* — Christensen O'Connor Johnson Kindness PLLC

(57) ABSTRACT

Assembly (1) for packaging and dispensing a product, in particular a cosmetic product, comprising a reservoir (10) delimiting an internal volume (14) intended to contain a product and comprising an opening (16*a*) for accessing said internal volume (14), provided with at least one inner shoulder (18*c*), and a member (20) for closing the opening (16*a*) of the reservoir, comprising a mounting skirt (22) that extends along an elevation axis (Z-Z') and is mounted in the reservoir, and closes the opening (16*a*) of said reservoir (10). The closure member (20) comprises a fastening lip (28) delimited axially by a proximal end (28*a*) connected to the mounting skirt (22) and a free distal end (28*b*), on the opposite side from the proximal end (28*a*), the fastening lip (28) being folded and radially surrounding the mounting skirt and the distal end (28*b*) of said fastening lip (28) butting axially against the shoulder (18*c*) of the reservoir (10).

10 Claims, 8 Drawing Sheets

(58) Field of Classification Search
CPC ..... B65D 43/021; B65D 41/086; B65D 41/0414; B65D 2255/20
USPC ..... 220/299
See application file for complete search history.

(56) References Cited

U.S. PATENT DOCUMENTS 3,578,203 A * 5/1971 Mainet ..... B29C 66/8322 220/795
4,177,933 A * 12/1979 Lumpp ..... B65D 51/1683 220/805
4,223,800 A * 9/1980 Fishman ..... B65D 43/022 220/521
4,393,976 A * 7/1983 Maguire ..... B65D 50/067 215/320
4,426,014 A * 1/1984 Coltman, Jr. ..... B65D 43/022 215/DIG. 1
4,438,864 A * 3/1984 Helms ..... B65D 15/08 229/125.17
5,096,077 A 3/1992 Odet et al.
8,235,956 B2 * 8/2012 Block ..... A61F 5/4556 206/524.1
8,317,043 B2 11/2012 Smith et al.
9,366,374 B2 * 6/2016 Krauer ..... F16L 55/132
11,827,426 B2 * 11/2023 Morren ..... B65D 47/2031
2009/0020546 A1 1/2009 Kiehne
2009/0065528 A1 * 3/2009 Bray ..... B65D 35/44 222/107
2016/0023818 A1 * 1/2016 Gelov ..... B65D 35/04 220/254.1
2016/0236827 A1 * 8/2016 Adams ..... B65D 35/44
2019/0127124 A1 * 5/2019 Dombowsky ..... B65D 43/022
2019/0375559 A1 * 12/2019 Spivey ..... B65D 43/0229
2021/0016935 A1 * 1/2021 Gregorian ..... B65D 85/12
2022/0089350 A1 * 3/2022 Dinkheller ..... B65D 81/2015
2023/0015993 A1 * 1/2023 Döbler ..... B65D 17/401
2023/0232896 A1 * 7/2023 LeNoir ..... A24F 9/14 131/243

* cited by examiner

CLOSURE MEMBER FOR AN ASSEMBLY FOR PACKAGING AND DISPENSING A PRODUCT, AND ASSEMBLY COMPRISING SUCH A CLOSURE MEMBER

CROSS-REFERENCES TO RELATED APPLICATIONS

This application is a National Stage of International Application No. PCT/EP2021/067686, filed Jun. 28, 2021, which claims the benefit of French Application No. 2006811, filed on Jun. 29, 2020, the disclosures of which are expressly incorporated herein by reference in their entirety.

The present invention relates to the field of assemblies for packaging and dispensing a cosmetic product.

More particularly, the invention relates to closure members or stoppers intended to close an opening of a container of the bottle or tube type containing a product.

A "cosmetic product" is understood, in particular within the meaning of the present invention, to be a product as defined in Regulation (EC) No 1223/2009 of the European Parliament and of the Council of 30 Nov. 2009 on cosmetic products.

More particularly, the present invention relates to closure members, also known as closure caps, made of synthetic material comprising a hollow cylindrical body that is intended to be fastened on the open end of the bottle to be closed, and a cover that is fastened to the body and movable with respect to said body between an open position opening the bottle and a closed position closing said bottle.

The cover is generally hinged to the body, for example by one or more hinges or articulations.

The cover could also be fastened to the body, for example by being screwed on, or by any other means.

Conventionally, such a closure member is fastened on the neck of a bottle by the cooperation of fastening means, such as external/internal thread systems or systems having a groove and a snap-fastening protrusion, which are provided on the outer surface of the neck of the bottle and the inner surface of a fastening skirt provided on the closure member and designed to extend radially around the neck of the bottle in the position fastening the closure member to the neck of the bottle.

However, this type of fastening requires the provision of a fastening skirt radially on the outside of the closure member and forces the use of a significant quantity of material, in particular plastic, for manufacturing the closure member. Furthermore, with such a type of fastening, the closure member has a large radial size.

Furthermore, the document EP 3 342 309-B1 discloses a container for a cosmetic product, comprising a neck forming an opening and a support mounted inside said neck. The neck comprises, on its inner cylindrical surface, a protrusion that extends towards the inside and cooperates with a radial protrusion provided on the outer cylindrical surface of the support in order to fasten said support in the neck.

Otherwise, the document EP 1 534 600-B1 discloses a container for a cosmetic product, comprising a neck forming an opening and a closure cap mounted inside said neck. That document proposes various embodiments for fastening the closure cap inside the neck of the container. However, such fastening systems increase the complexity of manufacturing the cap and the container and cannot ensure reliable fastening of the cap on the container.

On account of the constraints for demoulding the container, the radial dimensions of the reliefs provided on the inner surface of the neck of the container need to be small, and so the protrusions or bulges of the known prior art likewise have relatively small radial dimensions, thereby not making it possible to achieve satisfactory fastening and axial retention of the closure cap on the neck of the container.

Thus, there is a need to improve the fastening of the closure members on a container.

An aim of the present invention is therefore to overcome the above drawbacks and to improve the fastening of a closure member on a container, while maintaining a small radial size of said closure member.

Another objective of the invention is to make it easier to manufacture said closure member by moulding.

Another objective of the invention is to design a closure member of small radial size that requires a small quantity of material, in particular plastic, in order to be manufactured.

An object of the invention is an assembly for packaging and dispensing a cosmetic product comprising:

- a reservoir delimiting an internal volume intended to contain the cosmetic product and comprising an opening for accessing said internal volume, the inner surface of said opening comprising at least one shoulder; and
- a member for closing the opening of the reservoir, comprising a mounting skirt that extends along an elevation axis and is mounted in the reservoir, in particular inside the neck of the reservoir.

The mounting skirt is delimited axially by an open lower end and an upper end on the opposite side from the lower end, the closure member comprising an annular flange protruding radially towards the outside from the upper end of the mounting skirt, the annular flange comprising an outer diameter greater than the diameter of the opening of the reservoir and bearing axially against the upper end of said reservoir in the position fastening the closure member. The closure member further comprises a radial upper wall that closes the upper end of the mounting skirt and is provided with at least one dispensing orifice for the cosmetic product contained in the reservoir to pass through.

Said closure member comprises a fastening lip delimited axially by a proximal end connected to the mounting skirt and a free distal end, on the opposite side from the proximal end.

Said fastening lip, in the position fastening the closure member in the opening of the reservoir, is folded and radially surrounds the mounting skirt. The distal end of said fastening lip butts axially against the shoulder of the reservoir.

In an initial position not mounted of the closure member in the reservoir, the fastening lip protrudes towards the outside with respect to an outer cylindrical surface of the mounting skirt forming an obtuse angle with respect to said surface, and the free distal end of the fastening lip has an outer diameter greater than the inner diameter of the reservoir in order to obtain the turning of the fastening lip into the folded position fastening during the assembly of the closure member in the reservoir.

Advantageously, in the position fastening the closure member in the opening of the reservoir, the fastening lip protrudes towards the outside, with respect to an outer cylindrical surface of the mounting skirt, in a direction forming an acute angle with respect to said surface.

By virtue of the fastening lip radially surrounding the mounting skirt, reliable fastening of the closure member to a shoulder of the reservoir, in particular of the neck, even to a shoulder of small radial size is achieved.

A "shoulder" is understood to be any surface that is substantially normal to the elevation axis of a cylindrical component resulting from an abrupt change in diameter.

In an entirely non-limiting manner, the closure member is intended to close the opening in a neck of the reservoir. As a variant, provision could be made for the reservoir not to have a neck and for the closure member to close the open end of said reservoir. In this variant, the open end of the reservoir comprises an internal shoulder or annular protrusion that extends towards the inside of the reservoir and is intended to cooperate with the distal end of the fastening lip in the position fastening the closure member in the open end of the reservoir.

The closure member could also act as a reducer configured to reduce the flow section for the product through said closure member compared with the section of the internal volume of the reservoir. Such a reducer could, for example, be combined with a stopper or removable peg so as to avoid any flow of the product contained inside the reservoir towards the outside.

The acute angle formed between the direction of extension of the fastening lip and the outer cylindrical surface of the mounting skirt in the position fastening the closure member in the opening of the reservoir is, for example, between 5° and 45°, for example equal to 15°.

Thus, in the fastening position of the fastening lip, a free annular space is defined between the fastening lip and the outer cylindrical surface of the mounting skirt, this annular space allowing the fastening lip to bend elastically, allowing the closure member to be centred in the opening of the reservoir.

According to one advantageous provision, in the position fastening the closure member in the opening of the reservoir, the fastening lip is elastically loaded in the radial direction.

By virtue of these provisions, in the fastening position, the closure member is supported elastically in the radial direction and centred in the opening of the reservoir via the fastening lip. Furthermore, by virtue of these provisions, the reliability of the distal end of the fastening lip butting axially and being kept in axial abutment against the shoulder of the reservoir, in the position fastening the closure member in the opening of the reservoir, is reinforced.

Advantageously, the fastening lip comprises a cross section which increases, in particular gradually, between the proximal end and the distal end.

For example, the proximal end and the distal end of the fastening lip are connected by an internal frontal surface and an external frontal surface, the internal frontal surface being closer to the outer surface of the mounting skirt than the external frontal surface.

The internal frontal surface of the fastening lip may be in radial contact with the outer cylindrical surface of the mounting skirt.

As a variant, a space or radial clearance could be provided between the internal frontal surface of the fastening lip and the outer cylindrical surface of the mounting skirt.

For example, the fastening lip is annular. As a variant, provision could be made for the fastening lip to comprise segments that are spaced apart circumferentially from one another, in a regular or irregular manner. In other words, provision could be made for the fastening lip to be continuous or discontinuous in the circumferential direction.

Advantageously, the internal frontal surface and/or the external frontal surface of the fastening lip is frustoconical about the elevation axis.

For example, the reservoir, in particular its neck, comprises, on its inner surface, at least one annular recess delimited axially by the upper shoulder and a lower shoulder, the distal end of the fastening lip being disposed radially in said recess, bearing or in abutment axially against the upper shoulder, in particular in the position fastening the closure member.

An "annular recess" is understood to be a cylindrical notch or a groove formed in the inner surface of the neck of the reservoir.

According to one embodiment, the fastening lip is connected to a lower end of the mounting skirt. As a variant, provision could be made for the fastening lip to be connected to some other point on the outer surface of the mounting skirt.

For example, the reservoir comprises, at its upper end, a neck having an outer diameter less than the outer diameter of the body of the reservoir.

According to one embodiment, the closure member comprises a lid or cover that is hinged with respect to the mounting skirt by means of at least one articulation or hinge about a transverse pivot axis, perpendicular to the longitudinal elevation axis, between a closed or closing position, in which the dispensing orifice is closed, for example by a peg protruding axially towards the inside from an inner surface of the lid when the lid is in the closed position, and an open position, in which the dispensing orifice is free.

The cover may be connected to the mounting skirt for example by a hinge of the "film" hinge type or a strip that has a reduced thickness at the pivot axis so as to give the hinge bending properties.

Other systems for connecting the lid to the mounting skirt could be provided. For example, provision could be made for the cover to be screwed or snap-fastened into said mounting skirt. In this case, the mounting skirt would not comprise a radial upper wall provided with a dispensing orifice and would directly define an opening by way of its inner surface, itself provided with a screwing or snap-fastening relief designed to cooperate with a complementary screwing or snap-fastening relief provided on the cover.

Provision could also be made for the closure member not to comprise a lid, but rather a temporary membrane seal covering the dispensing orifice or a removable peg that is inserted into said dispensing orifice in a position closing said orifice and has radial and axial dimensions configured so as to be withdrawn from said orifice by the user before the packaging assembly is used.

According to one embodiment, the closure member comprises a sealing skirt protruding axially, and towards the inside, from the annular flange, radially surrounding the mounting skirt, at least partially, and in tight radial contact with the inner surface of the reservoir, in particular of the neck, in the position fastening the closure member.

For example, the sealing skirt is annular.

In the position fastening the closure member, the sealing skirt does not extend axially beyond the distal end of the fastening lip, so as not to interfere with said fastening lip.

The closure member for an assembly for packaging and dispensing a product, comprises a mounting skirt extending along an elevation axis and a fastening lip comprising a proximal end connected to the mounting skirt and a free distal end, on the opposite side from the proximal end.

Said fastening lip is hinged by its proximal end with respect to the outer surface of the mounting skirt by means of an articulation or hinge about an annular bending line, or annular turn-up line, extending around the elevation axis, in particular in a plane perpendicular thereto, and being movable between an initial position, in which the fastening lip protrudes towards the outside, with respect to an outer cylindrical surface of the mounting skirt, in a first direction forming a first, obtuse angle with respect to said surface, and a fastening position, in which the fastening lip protrudes towards the outside, with respect to the outer cylindrical surface of the mounting skirt, in a second direction forming a second, acute angle with respect to said surface.

The first angle is, for example, between 90° and 180°, for example equal to 120°.

The second angle is, for example, between 5° and 45°, for example equal to 15°.

Advantageously, the fastening lip comprises a cross section which increases, in particular gradually, between the proximal end and the distal end.

For example, the proximal end and the distal end of the fastening lip are connected by an internal frontal surface and an external frontal surface, the internal frontal surface being closer to the outer surface of the mounting skirt than the external frontal surface, the internal frontal surface of the fastening lip being for example in radial contact with the outer cylindrical surface of the mounting skirt in the position fastening the closure member.

For moulding a closure member as described above, the closure member may be moulded in the initial position in which the fastening lip is opened out with respect to the mounting skirt and the fastening lip is then demoulded by force.

In the initial moulding position, the obtuse angle defined between the fastening lip and the outer surface of the mounting skirt makes it possible for there to be a small radial dimension exhibiting an undercut during the moulding of the closure member and thus for it to be easier to demould the fastening lip by force, the latter also being able to bend about the annular bending line to accompany this demoulding by force.

The closure member is produced in one piece for example by injection-moulding a plastics material, for example a polymer such as polypropylene (PP), polyethylene (PE) or high-density polyethylene (HDPE), or any other polymeric composition having similar physical properties.

According to another aspect, the invention relates to a method for assembling an assembly for packaging and dispensing a product as described above, comprising the following successive steps:

- moving the closure member axially towards the reservoir, the fastening lip being in an initial position not mounted in the reservoir, in which said fastening lip protrudes towards the outside, with respect to an outer cylindrical surface of the mounting skirt, in a first direction forming a first, obtuse angle with respect to said surface;
- turning up the fastening lip of the closure member so as to cause said fastening lip to bend about an annular bending line, or annular turn-up line, extending around the elevation axis towards the outer surface of the mounting skirt; and
- inserting the mounting skirt of the closure member into the opening of the reservoir, by press-fitting it using an axial pushing force, in particular only in one direction, until the free distal end of the fastening lip is inserted under the shoulder of the reservoir, in particular into the annular recess of the reservoir. During the press-fitting of the mounting skirt into the reservoir, the fastening lip moves towards the outer surface of the mounting skirt until a fastening position is reached in which the fastening lip protrudes towards the outside, with respect to the outer cylindrical surface of the mounting skirt, in a second direction forming a second, acute angle with respect to said surface, and in which the free distal end of the fastening lip is in axial abutment against the upper shoulder of the reservoir.

In the fastening position, the free distal end of the fastening lip bears axially against the inner upper shoulder of the reservoir, in particular of the neck, preventing the closure member from being disassembled from the reservoir.

It is particularly simple to mount the closure member in the neck of the reservoir, only requiring an axial pushing force in only one direction.

Once the closure member has been mounted in the reservoir, it is no longer removable.

For example, the turning up of the fastening lip of the closure member is carried out when the fastening lip of the closure member is brought into contact with the reservoir.

As a variant, provision could be made for the step of turning up the fastening lip to be carried out, for example, manually, or in an automated manner, before the step of insertion into the opening of the reservoir. Bending the fastening lip before press-fitting or inserting the closure member into the reservoir has the advantage of allowing the mounting skirt to be centred in the opening of the reservoir by means of the fastening lip during this press-fitting or insertion.

In the initial position not mounted in the reservoir, the outer diameter of the distal end is greater than the inner diameter of the reservoir, in particular of its neck.

The turning or bending of said fastening lip during the assembly of said member in the neck of the reservoir, defining an acute angle between said fastening lip and the outer surface of the skirt, makes it possible to have a larger radial dimension than the radial dimension in the initial position, and thus reliable catching of said fastening lip on the upper shoulder of the neck.

The present invention will be understood better from studying the detailed description of embodiments that are given by way of entirely non-limiting examples and are illustrated by the appended drawings, in which.

In the rest of the description, reference will be made to an orthonormal basis X, Y, Z, where Z corresponds to an elevation axis representing the vertical direction. The expressions "upper" and "lower" refer to the upper part and the lower part of the figures.

Figure 1:
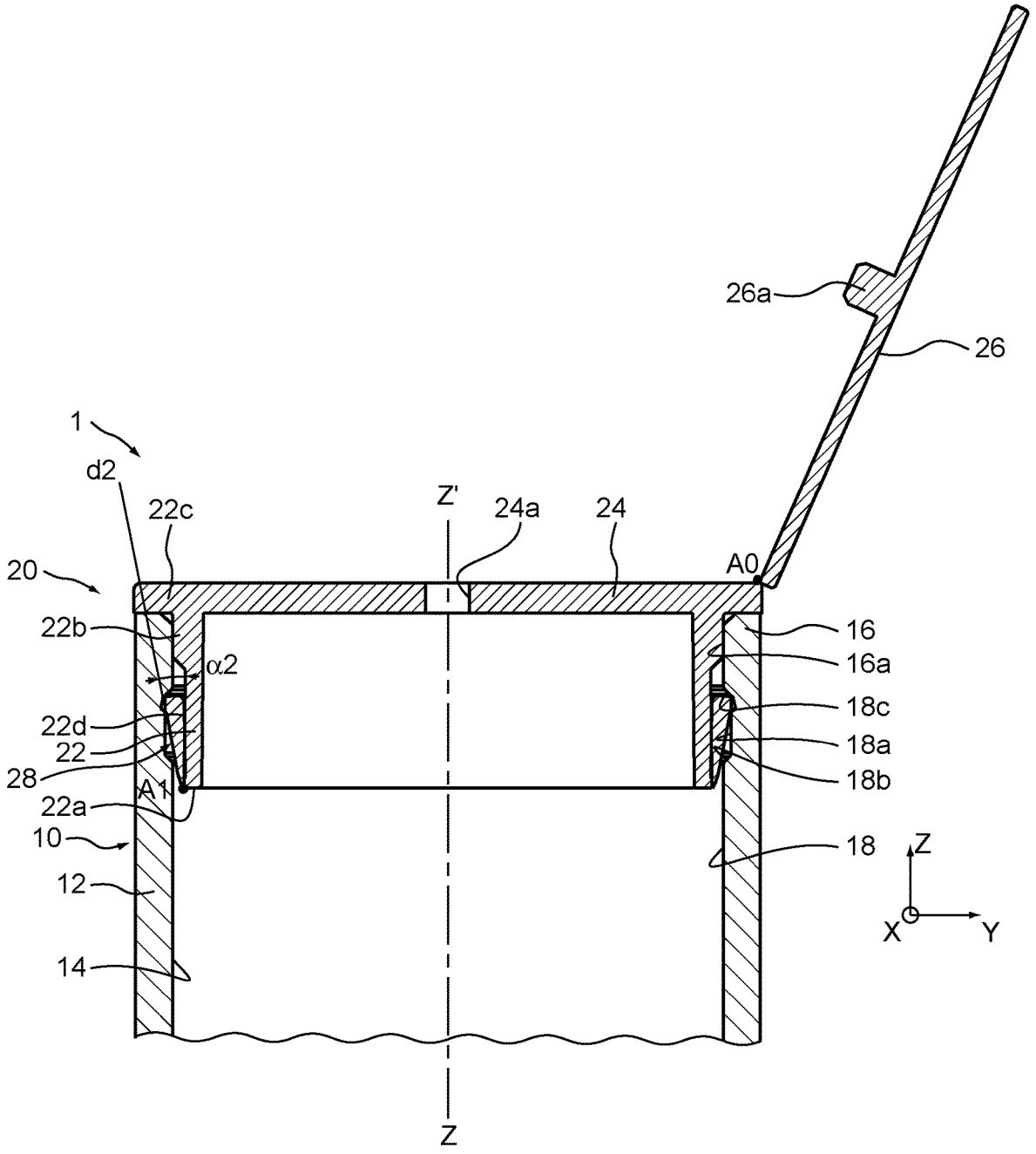
FIG. 1 is a view in partial axial section of an assembly for packaging and dispensing a product according to one embodiment of the invention.

FIG. 1 shows an assembly 1 for packaging and dispensing a cosmetic product.

A "product" is understood to be a liquid, semi-liquid or viscous product that is intended to flow out of a reservoir under the effect of gravity. The product may be a cosmetic product, such as a hygiene product, a care product or a makeup product, for example.

The assembly 1 for packaging and dispensing the product comprises a reservoir or container 10, for example in the form of a hollow body 12, delimiting an internal volume 14 containing a product. The reservoir 10 extends axially along an axis Z-Z' that is presumed to be vertical in the figures, from an upper end 16 forming a neck provided with an opening 16*a* for accessing the internal volume 14 to a lower end (not shown) forming the bottom of the reservoir.

The body of the reservoir 10 may be made, for example, of rigid synthetic material.

By way of non-limiting example, the neck 16 may have an outer diameter less than the outer diameter of the body 12 of the reservoir 10.

As illustrated, the neck 16 comprises, on its inner surface 18, an annular recess 18*a* delimited along the elevation axis, which in this case is vertical Z-Z', between a lower shoulder 18*b* and an upper shoulder 18*c*.

A "shoulder" is understood to be any surface that is substantially normal to the elevation axis of a cylindrical component resulting from an abrupt change in diameter.

As illustrated, the lower and upper shoulders 18*b*, 18*c* are surfaces substantially normal to the inner surface 18 of the neck 16 of the reservoir 10.

An "annular recess" is understood to be a cylindrical notch formed in the neck of the reservoir 10.

The assembly 1 for packaging and dispensing the product comprises a member 20 for closing the neck 16 of the reservoir 10.

Figure 2:
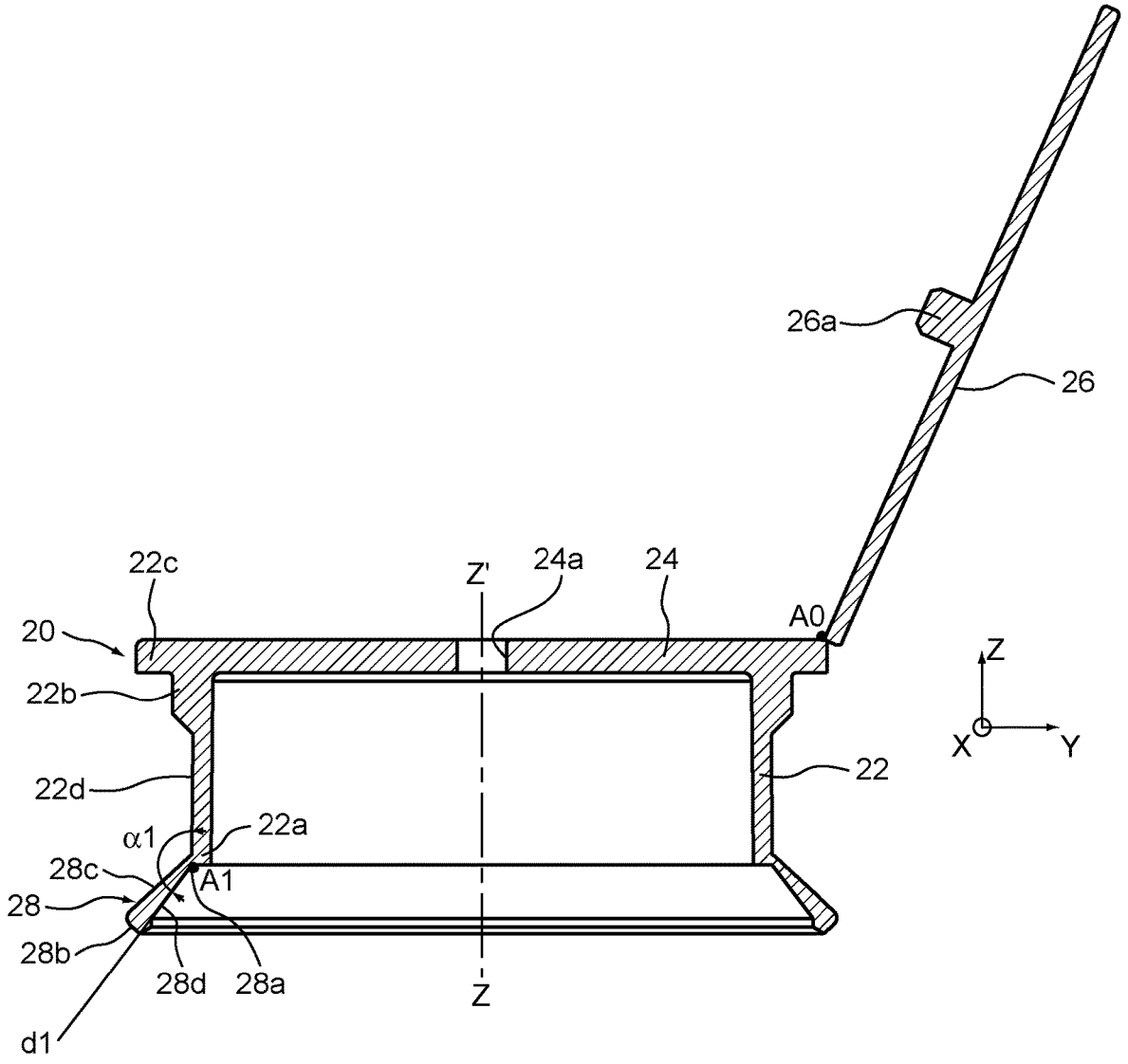
FIG. 2 is a view in axial section of a closure member of the assembly for packaging and dispensing a product in FIG. 1, in which the fastening lip is in an initial position, not mounted in the reservoir of the assembly in FIG. 1.

As illustrated in FIGS. 1 and 2, the closure member 20 comprises a mounting skirt or body 22 that is substantially cylindrical, extends along the elevation axis Z-Z', shown here in a vertical use position, and is configured to be mounted inside the neck 16 of the reservoir 10.

The mounting skirt 22 is delimited axially by an open lower end 22*a* and an upper end 22*b*, on the opposite side from the lower end 22*a*. The upper end 22*b* comprises a substantially annular flange 22*c* that has an outer diameter greater than the inner diameter of the neck 16 of the reservoir 10 and bears axially against the upper end of said neck 16 in the mounted position of the closure member 20, which can be seen in FIG. 1.

Advantageously, and as illustrated in particular in FIG. 1, in the position fastening the closure member 20 in the reservoir 10, the upper end 22*b* of the mounting skirt 22 is in tight radial contact with the inner surface of the neck 16.

The closure member 20 also comprises a radial upper wall 24 that closes the upper end 22*b* of the mounting skirt 22 and is provided with a dispensing orifice 24*a* for the product contained in the reservoir 10 to pass through.

As illustrated, the closure member 20 is a closure cap which also has a cap or cover 26 that is hinged with respect to the mounting skirt 22 by means of one or more articulations or hinges about a transverse pivot axis A0, along the transverse axis X, perpendicular to the elevation axis Z-Z', between an open position, which can be seen in FIG. 1, in which the dispensing orifice 24*a* is free, and a closed position, in which the dispensing orifice 24 is closed by a closure peg or stud 26*a* protruding axially towards the inside from an inner surface of the cover 26 when said cover 26 is in the closed position.

The cover 26 may be connected to the mounting skirt 22 for example by a hinge of the "film" hinge type or a strip that has a reduced thickness at the pivot axis A0 so as to give the hinge bending properties.

Other systems for connecting the cover 26 to the mounting skirt 22 could be provided. For example, provision could be made for the cover 26 to be screwed or snap-fastened into said mounting skirt 22. In this case, the mounting skirt 22 would not comprise a radial upper wall provided with a dispensing orifice and would directly define an opening by way of its inner surface, itself provided with a screwing or snap-fastening relief designed to cooperate with a complementary screwing or snap-fastening relief provided on the cover.

Provision could also be made for the closure member 20 not to comprise a pivoting lid, but rather a temporary membrane seal covering the dispensing orifice 24*a* or a removable peg that is inserted into said dispensing orifice in a position closing said orifice and has radial and axial dimensions configured so as to be withdrawn from said orifice by the user before the packaging assembly is used.

Provision could also be made for the closure member 20 to be a reducer configured to reduce the flow section for the product through said closure member compared with the section of the internal volume 14 of the reservoir 10. Such a reducer could, for example, be combined with a stopper or removable peg.

The closure member 20 comprises a fastening lip 28 that is hinged with respect to the mounting skirt 22 by means of an articulation or hinge about an annular bending line A1 extending around the elevation axis Z-Z', between an initial position, which can be seen in FIG. 2, in which the closure member 20 is not mounted in the neck 16 of the reservoir 10, and a fastening position, which can be seen in FIG. 1, in which the closure member 20 is mounted in the neck 16 of the reservoir 10.

In the initial position of the fastening lip 28, the latter protrudes towards the outside, with respect to the outer cylindrical surface 22*d* of the mounting skirt 22, in a first direction d1 forming a first, obtuse angle $\alpha$1 with respect to said surface 22*d*. The first angle is, for example, between 90° and 180°, for example equal to 120°.

In the fastening position of the fastening lip 28, the latter protrudes towards the outside, with respect to the outer cylindrical surface 22*d* of the mounting skirt 22, in a second direction d2 forming a second, acute angle $\alpha$2 with respect to said surface 22*d*. The second angle $\alpha$2 is, for example, between 5° and 45°, for example equal to 15°. Thus, in the fastening position of the fastening lip 28, a free annular space is defined between the fastening lip 28 and the outer cylindrical surface 22*d* of the mounting skirt 22, this annular space allowing the fastening lip 28 to bend elastically, allowing the closure member to be centred in the opening 16*a* of the reservoir 10.

Advantageously, in the position fastening the closure member 20 in the opening 16*a* of the reservoir 10, the fastening lip 28 is elastically loaded in the radial direction.

Thus, in the fastening position, the closure member 20 is supported elastically in the radial direction and centred in the opening 16*a* of the reservoir 10 via the fastening lip 28. Furthermore, the reliability of the distal end 28*b* of the fastening lip 28 butting axially and being kept in axial abutment against the shoulder 18*c* of the reservoir 10, in the position fastening the closure member 20 in the opening 16*a* of the reservoir 10, is thus reinforced.

The fastening lip 28 may be connected to the mounting skirt 22 for example by a hinge of the "film" hinge type or a strip that has a reduced thickness at the bending line A1 so as to give the hinge bending properties.

As illustrated, the fastening lip 28 is connected to the lower end 22*a* of the mounting skirt 22. As a variant, provision could be made for the fastening lip 28 to be connected to some other point on the outer surface of the mounting skirt 22.

The fastening lip 28 may be annular or may comprise segments that are spaced apart circumferentially from one another, in a regular or irregular manner. In other words, provision may be made for the fastening lip to be continuous or discontinuous in the circumferential direction.

The fastening lip 28 comprises a proximal end 28*a* connected to the mounting skirt 22 and a free distal end 28*b*, on the opposite side from the proximal end 28*a*.

The fastening lip 28 comprises a cross section which increases between the proximal end 28*a* and the distal end 28*b*. In the exemplary embodiment illustrated, the cross section of the fastening lip 28 increases gradually towards the distal end 28*b*.

The proximal end 28*a* and the distal end 28*b* are connected by two opposite frontal surfaces 28*c*, 28*d*, namely an internal frontal surface 28*c* and an external frontal surface 28*d*.

In the position fastening the closure member 20 in the opening 16*a* of the reservoir 10, the internal frontal surface 28*c* is closer to the outer surface of the mounting skirt 22 than the external frontal surface 28*d*.

The first and second angles α1, α2 are defined between the external frontal surface 28*d* and the outer cylindrical surface 22*d* of the mounting skirt 22 in the initial position and in the position fastening the closure member 20 in the reservoir, respectively.

In the initial position, the outer diameter of the distal end 28*b* is greater than the inner diameter of the reservoir 10, in particular of its neck 16.

As illustrated in FIG. 1, in the fastening position, the internal frontal surface 28*c* of the fastening lip 28 is in radial contact with the outer cylindrical surface 22*d* of the mounting skirt 22.

Provision could also be made to use the closure member 20 to close the open end of a tube head equipping a reservoir 10 without a neck, such as a tube, or even to directly close the open end of a tube. The open end of the tube or of the tube head comprises an internal shoulder or annular protrusion that extends towards the inside of the reservoir and is intended to cooperate with the distal end 28*b* of the fastening lip 28 in the position fastening the closure member 20 in the open end of the reservoir 10.

Figure 3:
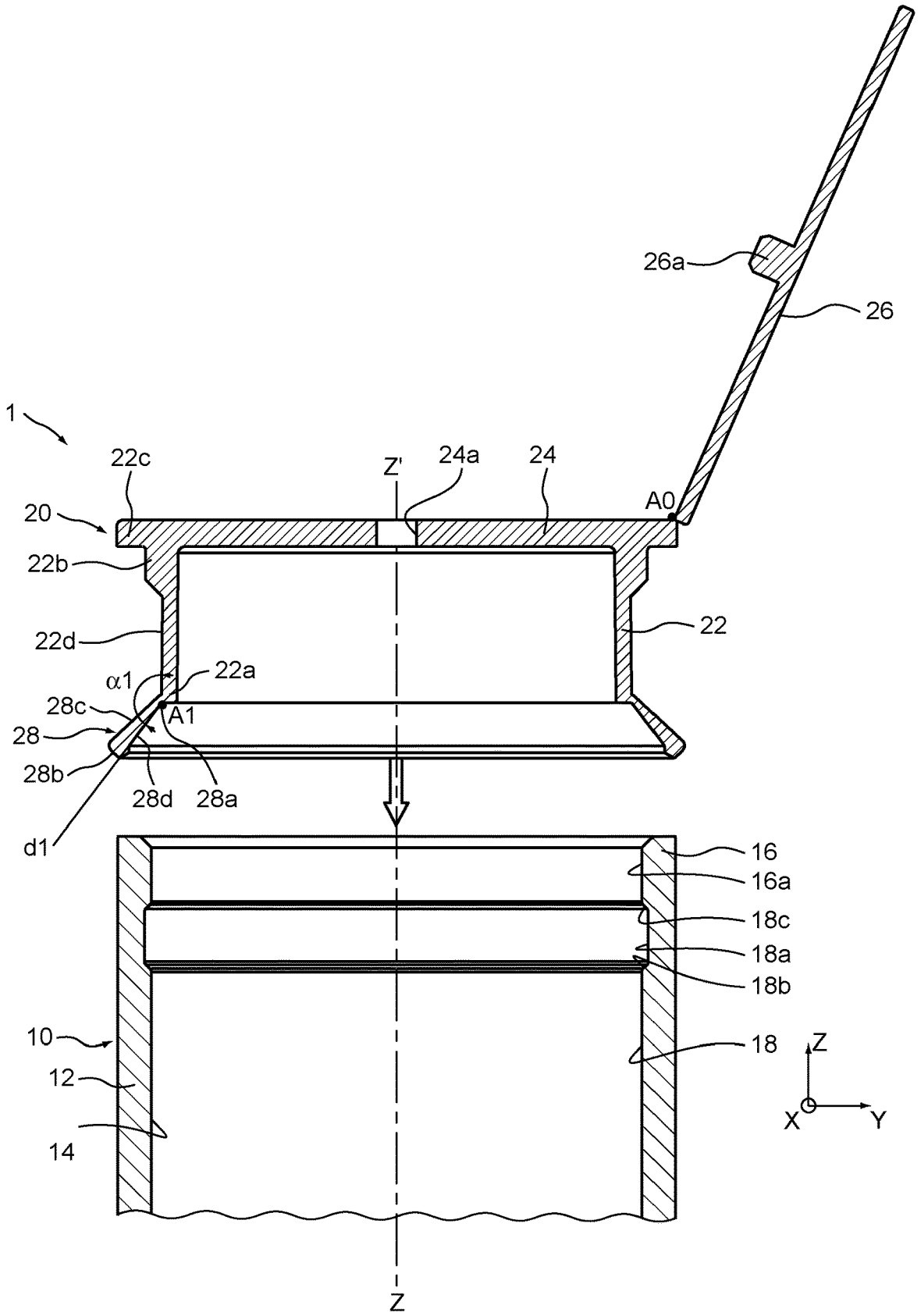
FIG. 3, FIG. 4 and FIG. 5 illustrate the steps of assembling the closure member in FIG. 2 in a reservoir of the assembly in FIG. 1.
Figure 4:
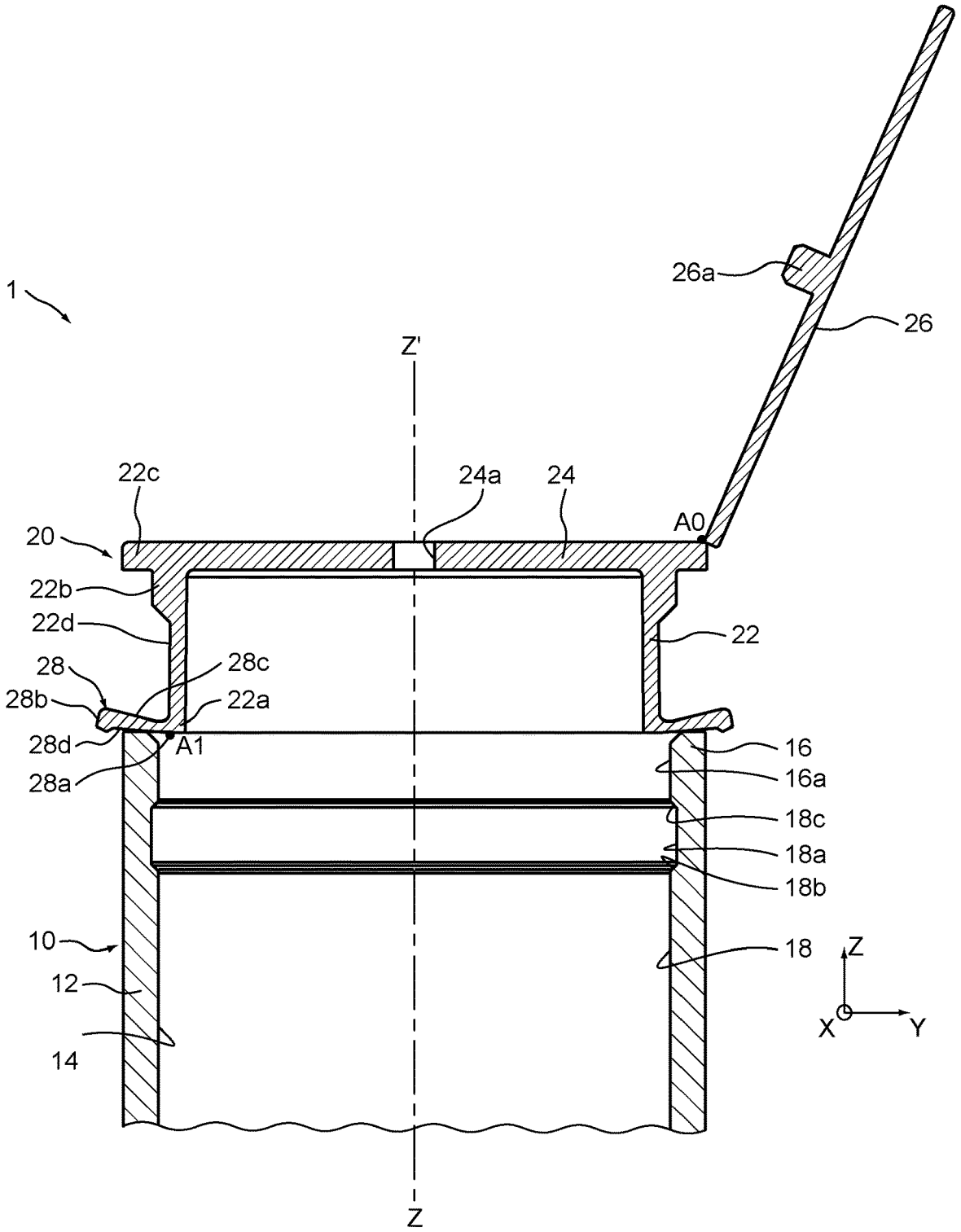
Figure 5:
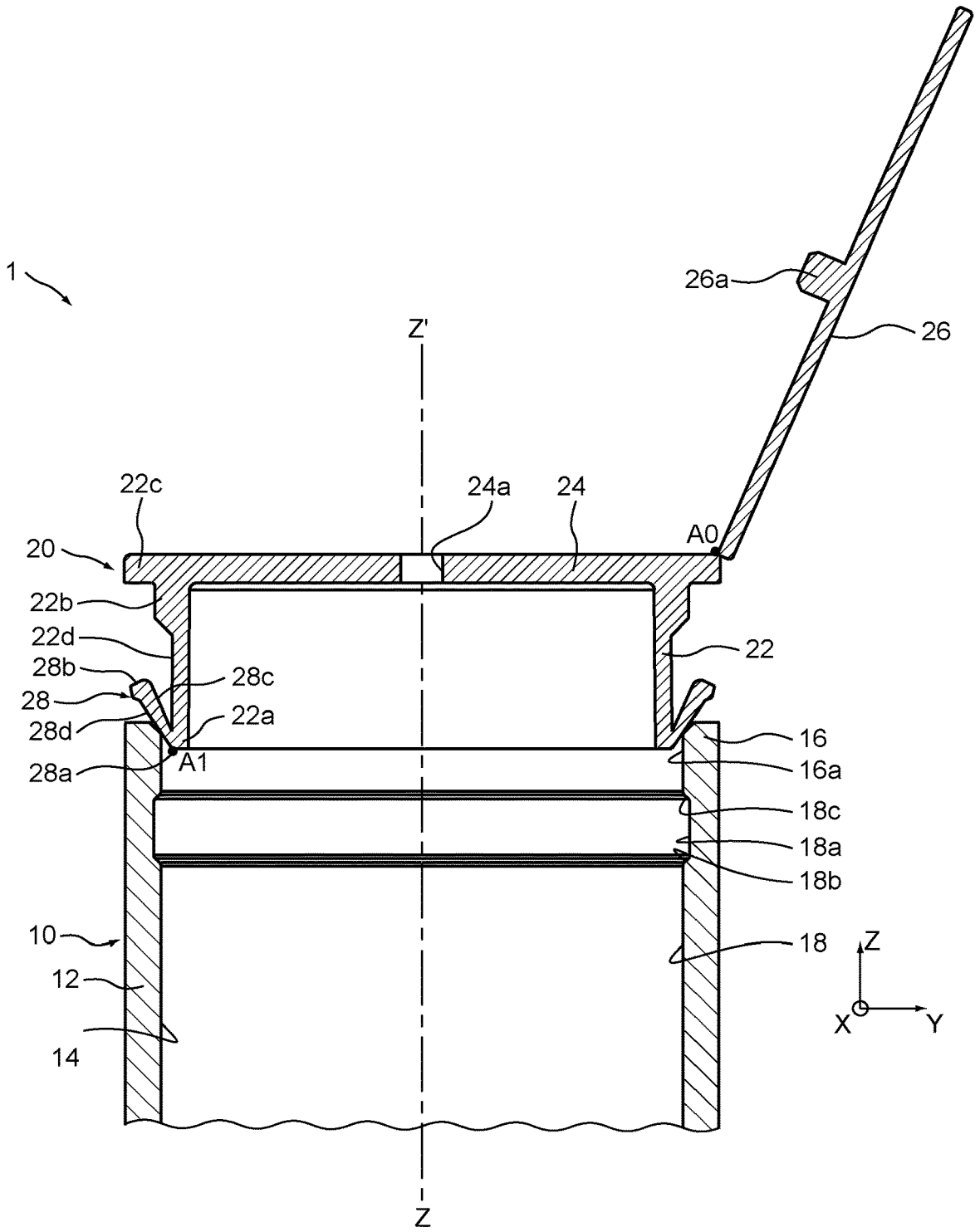

An example of assembling the assembly 1 for packaging and dispensing a product is carried out using the following method, with reference to FIGS. 3 to 5.

The closure member 20 is moved towards the reservoir 10 along the longitudinal axis Z-Z', which can be seen in FIG. 3, until it comes into contact with said reservoir, as can be seen in FIG. 4.

At the end of the moving step, the closure member 20 is no longer in its initial position not mounted in the reservoir, in which the fastening lip 28 protrudes towards the outside, with respect to an outer cylindrical surface 22*d* of the mounting skirt 22, in the first direction d1 forming the first, obtuse angle α1 with respect to said surface 22*d*. Specifically, at the end of the moving step, the external frontal surface 28*d* of the fastening lip 28 of the closure member 20 comes into contact with the upper end 16 of the reservoir, so as to cause said fastening lip 28 to bend about the bending line A1 towards the outer surface 22*d* of the mounting skirt 22. The bringing of the fastening lip 28 into contact with the reservoir 10 corresponds to a step of turning up said lip 28.

The mounting skirt 22 of the closure member 20 is then inserted into the opening 16*a* of the neck 16 of the reservoir 10 by press-fitting, as can be seen in FIG. 5.

In this intermediate position of assembly or insertion into the opening 16*a* of the reservoir 10, the internal frontal surface 28*c* of the fastening lip 28 moves towards the outer surface 22*d* of the mounting skirt 22.

The mounting skirt 22 of the closure member 20 is press-fitted until the annular flange 22*c* comes to bear axially against the upper end 22*b* of the mounting skirt 22 and the free distal end 28*b* of the fastening lip is inserted into the annular recess 18*a* of the neck, in particular by elastic return. The free distal end 28*b* of the fastening lip then bears axially against the inner upper shoulder 18*c* of the neck 16, preventing the closure member 20 from being disassembled from the reservoir 10.

In the fastening position, which can be seen in FIG. 1, the fastening lip 28 protrudes towards the outside, with respect to the outer cylindrical surface 22*d* of the mounting skirt 22, in a second direction d2 forming a second, acute angle α2 with respect to said surface 22*d*.

By virtue of the flexible fastening lip, reliable fastening of the closure member 20 against an inner shoulder of the reservoir is achieved even with a shoulder of small radial size, this fastening lip 28 then acting in the manner of a harpoon so as to be immobilized in the elevation axis Z-Z' behind the inner shoulder 18*c* of the neck 16 and thus to prevent the withdrawal of the closure member 20 from the reservoir 10.

It is particularly simple to mount the closure member 20 in the neck 16 of the reservoir 10, only requiring an axial pushing force in only one direction extending along the elevation axis Z-Z'.

Once the closure member 20 has been mounted in the neck 16 of the reservoir 10, it is no longer removable.

As a variant, provision could be made for the step of turning up the fastening lip 28, during which the fastening lip 28 of the closure member 20 bends about the bending line A1 towards the outer surface 22*d* of the mounting skirt 22, to be carried out before the step of insertion into the opening 16*a* of the reservoir 10.

The turn-up step may, for example, be carried out manually or be automated.

Bending the fastening lip 28 before press-fitting or inserting the closure member 20 into the reservoir 10 has the advantage of centring the mounting skirt 22 with respect to the reservoir 10. Specifically, the external frontal surface 28*d* of the turned-up fastening lip 28 defines a frustoconical bearing surface that makes it easier to insert the mounting skirt 22 into and centre it in the opening 16*a* of the reservoir 10 during the press-fitting of the closure member 20 into the opening 16*a* of the reservoir 10.

With reference to FIGS. 3 and 5, such an assembly method comprises the following successive steps: a step of moving the closure member 20 towards the reservoir 10 along the longitudinal axis Z-Z', which can be seen in FIG. 3, a step of turning up (not shown) the fastening lip 28 so as to cause said fastening lip 28 to bend about the bending line A1 towards the outer surface 22*d* of the mounting skirt 22, and a step of inserting the mounting skirt 22 of the closure member 20 into the opening 16*a* of the neck 16 of the reservoir 10 by press-fitting, as can be seen in FIG. 5.

In this position inserted into the opening 16*a* of the reservoir 10, the internal frontal surface 28*c* of the fastening lip 28 moves further towards the outer surface 22*d* of the mounting skirt 22. The closure member 20 is made in one piece for example by injection-moulding a plastics material, for example a polymer such as polypropylene (PP), polyethylene (PE) or high-density polyethylene (HDPE), or any other polymeric composition having similar physical properties.

Figure 6:
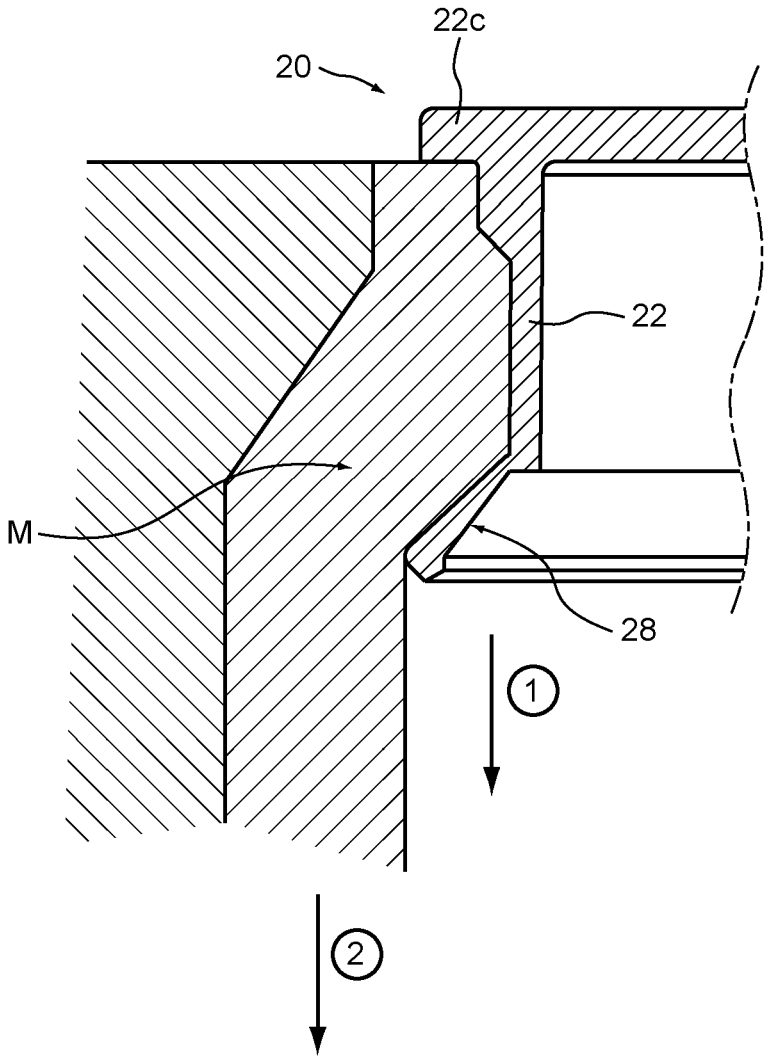
FIG. 6 shows a step of demoulding the closure member in FIG. 2.

As illustrated in FIG. 6, the closure member 20 is moulded in a mould M in the initial position in which the fastening lip 28 is opened out with respect to the mounting skirt 22 and extends in a direction away from the annular flange 22*c*. The closure member 20 is first of all demoulded by removing a first mould along the arrow 1, and then the fastening lip 28 is demoulded by force by removing a second mould along the arrow 2.

In the initial moulding position, the obtuse angle defined between the fastening lip 28 and the outer surface of the mounting skirt 22 makes it possible for there to be a small radial dimension exhibiting an undercut during the moulding of the closure member 20 and thus for it to be easier to demould the fastening lip 28 by force along the arrow 2 in FIG. 6, said fastening lip also being able to bend about the annular bending line to accompany this demoulding by force.

The turning or bending of said fastening lip during the assembly of said member 20 in the neck 16 of the reservoir 10, defining an acute angle between said fastening lip 28 and the outer surface of the skirt 22, makes it possible to have a larger radial dimension than the radial dimension in the initial position, and thus reliable catching of said fastening lip 28 on the upper shoulder of the neck 16.

Figure 7:
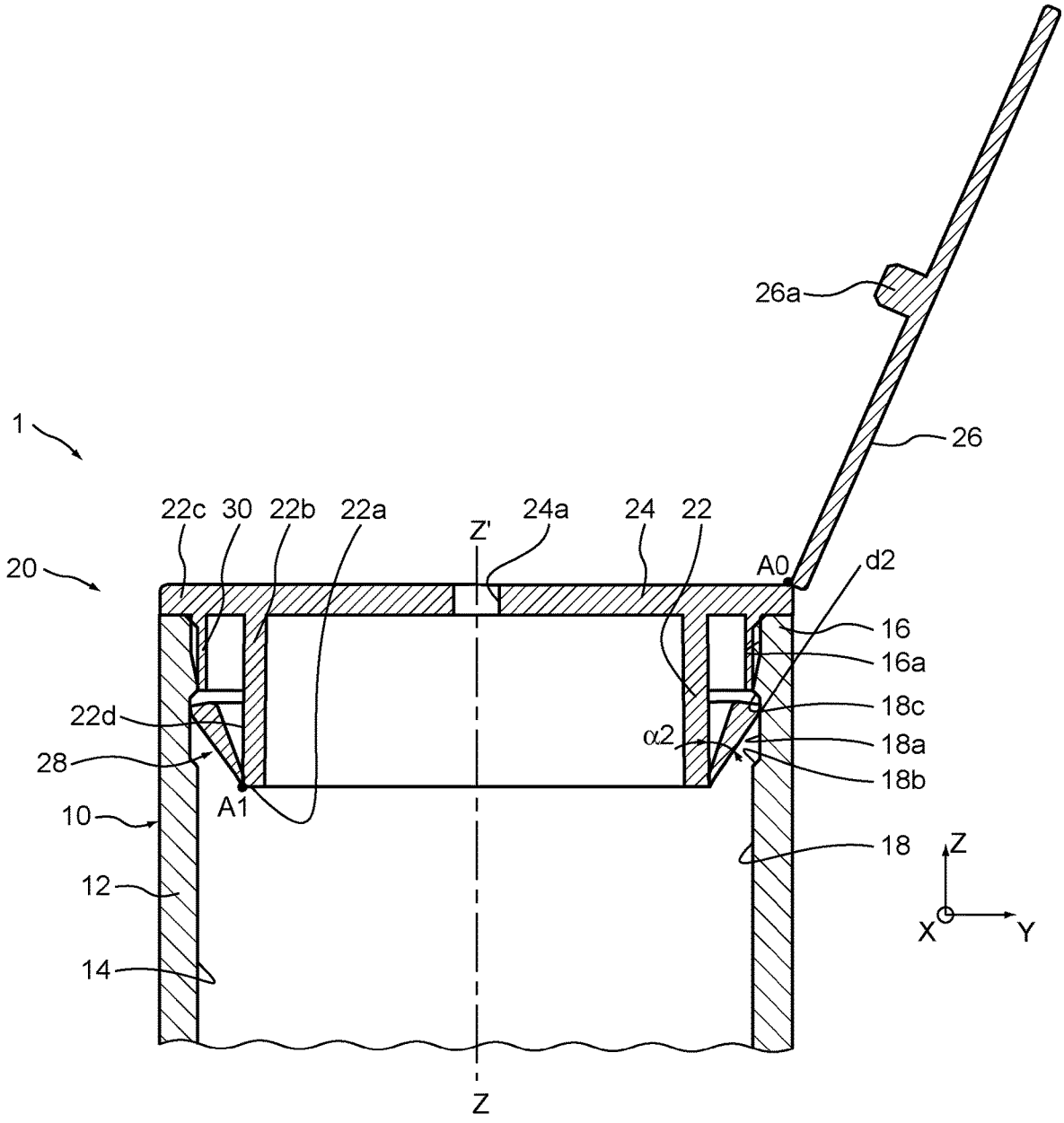
FIG. 7 is a view in partial axial section of an assembly for packaging and dispensing a product according to a second embodiment of the invention.
Figure 8:
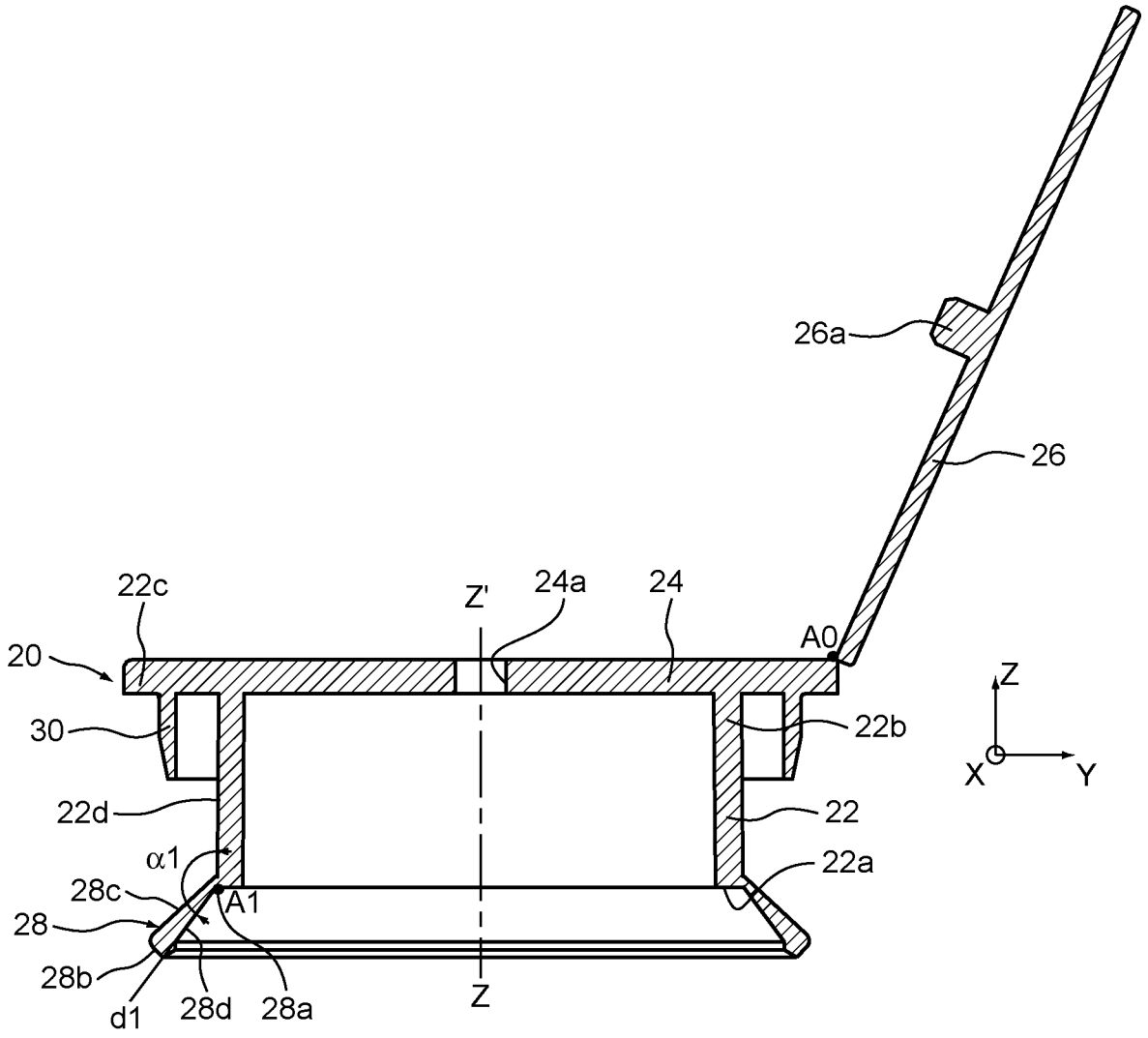
FIG. 8 is a view in axial section of a closure member of the assembly for packaging and dispensing a product in FIG. 7, in which the fastening lip is in an initial position, not mounted in the reservoir of the assembly in FIG. 7.

The embodiment illustrated in FIGS. 7 and 8, in which identical elements bear the same references, differs from the embodiment illustrated in FIGS. 1 and 2 only in that the closure member 20 comprises a sealing skirt 30 protruding axially towards the inside from the annular flange 22*c*.

The sealing skirt 30 is coaxial with the mounting skirt 22 and radially surrounds said skirt 22 partially.

The sealing skirt 30 may be annular.

In the position fastening the closure member 20 in the neck 16 of the reservoir, the sealing skirt 30 is in tight radial contact with the inner surface of said neck 16.

In the fastening position, the sealing skirt 30 does not extend axially beyond the distal end 28*b* of the fastening lip 28, so as not to interfere with said fastening lip 28.

By virtue of the invention, the fastening of the closure member on the container is improved, while maintaining a small radial size of said closure member, making it easier to manufacture said member by moulding and minimizing the quantity of material required to produce it.

The invention claimed is:

1. Assembly (1) for packaging and dispensing a cosmetic product comprising:

a reservoir (10) delimiting an internal volume (14) intended to contain the cosmetic product and comprising an opening (16*a*) for accessing said internal volume (14), the inner surface of said opening comprising at least one shoulder (18*c*); and a member (20) for closing the opening (16*a*) of the reservoir, comprising a mounting skirt (22) extending along an elevation axis (Z-Z'), mounted in the reservoir, and delimited axially by an open lower end (22*a*) and an upper end (22*b*) on the opposite side from the lower end (22*a*), a closure member (20) comprising an annular flange (22*c*) protruding radially towards the outside from the upper end (22*b*) of the mounting skirt (22), the annular flange (22*c*) comprising an outer diameter greater than the diameter of the opening (16*a*) of the reservoir (10) and bearing axially against the upper end of said reservoir, the closure member (20) further comprising a radial upper wall (24) that closes the upper end (22*b*) of the mounting skirt (22) and is provided with at least one dispensing orifice (24*a*) for the cosmetic product contained in the reservoir (10) to pass through, characterized in that said closure member (20) comprises:

a fastening lip (28) delimited axially by a proximal end (28*a*) connected to the mounting skirt (22) and a free distal end (28*b*), on the opposite side from the proximal end (28*a*), the fastening lip (28), in the position fastening the closure member in the opening of the reservoir, being folded and radially surrounding the mounting skirt, the distal end (28*b*) of said fastening lip (28) butting axially against the shoulder (18*c*) of the reservoir (10), and in that in an initial position where the closure member (20) is not mounted in the reservoir (10), the fastening lip (28) protrudes towards the outside with respect to an outer cylindrical surface (22*d*) of the mounting skirt (22) forming an obtuse angle (a1) with respect to said surface (22*d*), and the free distal end (28*b*) of the fastening lip has an outer diameter greater than the inner diameter of the reservoir (10) in order to obtain the turning of the fastening lip (28) into the folded position fastening during the assembly of the closure member (20) in the reservoir (10).

2. Assembly (1) according to claim 1, wherein, in the position fastening the closure member (20) in the opening (16*a*) of the reservoir (10), the fastening lip (28) protrudes towards the outside, with respect to an outer cylindrical surface (22*d*) of the mounting skirt (22), in a direction (d2) forming an acute angle (a2) with respect to said surface (22*d*).

3. Assembly (1) according to claim 1, wherein the fastening lip (28) comprises a cross section which increases, in particular gradually, between the proximal end (28*a*) and the distal end (28*b*).

4. Assembly (1) according to claim 1, wherein the proximal end (28*a*) and the distal end (28*b*) of the fastening lip (28) are connected by an internal frontal surface (28*c*) and an external frontal surface (28*d*), the internal frontal surface (28*c*) of the fastening lip (28) being for example in radial contact with the outer cylindrical surface of the mounting skirt (22).

5. Assembly (1) according to claim 1, wherein the reservoir comprises, on its inner surface, at least one annular recess (18*a*) delimited axially by the upper shoulder (18*c*) and a lower shoulder (18*b*), the distal end (28*b*) of the fastening lip (28) being disposed radially in said recess (18*a*).

6. Assembly (1) according to claim 1, wherein the fastening lip (28) is connected to a lower end (22*a*) of the mounting skirt (22).

7. Assembly (1) according to claim 1, wherein the closure member (20) comprises a lid (26) that is hinged with respect to the mounting skirt (22) by means of at least one articulation about a transverse pivot axis (A0), perpendicular to the elevation axis (Z-Z'), between a closed position, in which the dispensing orifice (24*a*) is closed, and an open position, in which the dispensing orifice (24*a*) is free.

8. Assembly (1) according to claim 1, wherein the closure member (20) comprises a sealing skirt (30) protruding axially, and towards the inside, from the annular flange (22*c*), radially surrounding the mounting skirt (22), at least partially, and in radial contact with the inner surface of the reservoir (10), in the position fastening the closure member (20).

9. Method for assembling an assembly (1) for packaging and dispensing a product according to claim 1 comprising the following successive steps:

moving the closure member (20) axially towards the reservoir (10), the fastening lip (28) being in an initial position not mounted in the reservoir, in which said fastening lip (28) protrudes towards the outside, with respect to an outer cylindrical surface (22*d*) of the mounting skirt (22), in a first direction (d1) forming a first, obtuse angle (a1) with respect to said surface (22*d*);

turning up the fastening lip (28) of the closure member (20) so as to cause said fastening lip (28) to bend about an annular bending line (A1), or annular turn-up line, extending around the elevation axis (Z-Z') towards the outer surface (22*d*) of the mounting skirt (22); and inserting the mounting skirt (22) of the closure member (20) into the opening (16*a*) of the reservoir (10), by press-fitting it using an axial pushing force, until the free distal end (28*b*) of the fastening lip (28) is inserted under the shoulder (18*c*) of the reservoir (10), during the press-fitting of the mounting skirt (22) into the reservoir (10), the fastening lip (28) moves towards the outer surface (22*d*) of the mounting skirt (22) until a fastening position is reached in which the fastening lip (28) protrudes towards the outside, with respect to the outer cylindrical surface (22*d*) of the mounting skirt (22), in a second direction (d2) forming a second, acute angle (a2) with respect to said surface, and in which the free distal end (28*b*) of the fastening lip (28) is in axial abutment against the shoulder (18*c*) of the reservoir (10).

10. Assembly method according to claim 9, wherein the turning up of the fastening lip (28) of the closure member (20) is carried out when the fastening lip (28) of the closure member (20) is brought into contact with the reservoir (10).

* * * * *